US010989485B2

(12) United States Patent
Zanchetta et al.

(10) Patent No.: US 10,989,485 B2
(45) Date of Patent: Apr. 27, 2021

(54) HEAT EXCHANGER TUBE, AND CORRESPONDING HEAT EXCHANGER PRODUCTION METHOD

(75) Inventors: Patrick Zanchetta, Betheny (FR); Jean-Jacques Garcia, Reims (FR); Francois Beideler, Reims (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 225 days.

(21) Appl. No.: 14/008,734

(22) PCT Filed: Mar. 30, 2012 (Under 37 CFR 1.47)

(86) PCT No.: PCT/EP2012/055790
§ 371 (c)(1), (2), (4) Date: Sep. 22, 2014

(87) PCT Pub. No.: WO2012/131038
PCT Pub. Date: Oct. 4, 2012

(65) Prior Publication Data

US 2015/0107812 A1 Apr. 23, 2015

(30) Foreign Application Priority Data

Mar. 31, 2011 (FR) ..... 1152705

(51) Int. Cl.
*F28F 1/00* (2006.01)
*F28D 1/03* (2006.01)
(Continued)

(52) U.S. Cl.
CPC ..... *F28F 1/00* (2013.01); *B21D 53/06* (2013.01); *F28D 1/0391* (2013.01); *F28F 1/022* (2013.01);
(Continued)

(58) Field of Classification Search
CPC ..... F28F 1/022; F28F 1/40; F28F 2225/04; F28F 1/025; F28D 1/05358; F28D 1/0391;
(Continued)

(56) References Cited

U.S. PATENT DOCUMENTS 2,023,047 A * 12/1935 Ganoe ..... E06B 9/52 138/166
2,085,829 A * 7/1937 Rogers ..... B21C 37/065 29/897.35
(Continued)

FOREIGN PATENT DOCUMENTS

DE 102004049809 A1 4/2006
DE 102006006670 A1 8/2007
(Continued)

OTHER PUBLICATIONS

English translation of FR2923591, obtained on Aug. 13, 2018, 5 pages.*
(Continued)

*Primary Examiner* — Joel M Attey
*Assistant Examiner* — For K Ling
(74) *Attorney, Agent, or Firm* — Howard & Howard Attorneys PLLC

(57) ABSTRACT

The invention relates to a heat exchanger tube produced by bending a metal strip (11), characterized in that said strip (11) has a thickness that can vary between at least one first thickness ($e_1$) and at least one second thickness ($e_2$) greater than said first thickness ($e_1$), and in that said tube has thinned first zones (Z1) and reinforced second zones (Z2) located at the points of greatest mechanical stress, said first zones (Z1) being formed by first portions (P1) of said strip of first thickness ($e_1$) and said reinforced second zones (Z2) being formed by second portions (P2) of said strip (11) of second
(Continued)

thickness ($e_2$). The invention also relates to a heat exchanger comprising a core bundle of such tubes, and to a method of obtaining such a tube.

18 Claims, 2 Drawing Sheets

(51) Int. Cl.
*F28D 1/02* (2006.01)
*B21D 53/06* (2006.01)
*F28F 1/02* (2006.01)

(52) U.S. Cl.
CPC ..... *F28F 2225/04* (2013.01); *Y10T 29/49391* (2015.01)

(58) Field of Classification Search
CPC ..... F28D 1/0358; F28D 1/02; B27C 37/14; B27C 37/151; B27C 37/154; B27C 37/156; F16L 9/17; F16L 9/04; B21D 35/006; B21D 53/04; B21D 53/06; B21D 5/083; B21C 37/151; B21C 37/065; B21B 1/224; B21B 1/227; B21B 1/222; B21B 2001/221; B21B 1/08
USPC ..... 165/177, 183, 906; 428/595, 600, 602
See application file for complete search history.

(56) References Cited

U.S. PATENT DOCUMENTS 3,209,432 A * 10/1965 Cape ..... B21C 37/065 29/897.2
4,317,350 A * 3/1982 Sivachenko ..... F16S 1/06 228/173.6
4,570,700 A * 2/1986 Ohara ..... F25B 39/02 165/134.1
4,603,806 A * 8/1986 Watanabe ..... B21C 37/065 138/171
4,696,346 A * 9/1987 Ryan ..... A01L 11/00 168/45
4,735,074 A * 4/1988 Saito ..... B21B 1/0805 72/201
5,058,266 A * 10/1991 Knoll ..... B23K 1/0012 165/179
5,765,634 A * 6/1998 Martins ..... F28D 1/0391 165/177
5,784,776 A * 7/1998 Saito ..... B21B 1/227 29/727
5,953,949 A * 9/1999 Behr ..... B21B 1/0805 72/224
6,129,147 A * 10/2000 Dumetz ..... F28D 1/0391 165/177
6,192,977 B1 2/2001 Dey et al.
6,230,533 B1 * 5/2001 Laveran ..... B21C 37/14 165/177
6,591,900 B1 * 7/2003 Kato ..... F28D 1/0391 138/115
7,086,153 B2 * 8/2006 Yamauchi ..... B21C 37/151 29/890.045
7,182,128 B2 * 2/2007 Yu ..... B21C 37/08 165/177
8,091,621 B2 * 1/2012 Zobel ..... B21C 37/151 165/177
8,353,335 B2 * 1/2013 Ploppa ..... F28F 1/02 165/168
8,683,690 B2 * 4/2014 Zobel ..... B21C 37/151 165/177
2004/0194943 A1 10/2004 Yamauchi
2005/0092476 A1 * 5/2005 Hu ..... F28D 1/0391 165/177
2007/0119581 A1 * 5/2007 Kato ..... F28D 1/0391 165/177
2007/0295490 A1 12/2007 Haegele
2009/0120617 A1 * 5/2009 Denoual ..... B21C 37/14 165/104.19
2011/0005738 A1 * 1/2011 Vetter ..... F28F 1/02 165/177

FOREIGN PATENT DOCUMENTS

DE 102008007611 A1 * 8/2009 ..... F02B 29/0462
EP 1014024 A1 6/2000
EP 2177282 A1 * 4/2010 ..... B21C 37/065
FR 2869678 A1 11/2005
FR 2923591 A1 * 5/2009 ..... B21C 37/14
GB 2133525 A * 7/1984 ..... F25B 39/02
JP H10122778 A 5/1998
JP 2001050676 A * 2/2001 ..... F28D 1/0391
JP 2002071286 A * 3/2002 ..... F28D 1/0391
JP 2003071532 A * 3/2003 ..... F28D 1/0391
JP 2004255400 A * 9/2004 ..... B21C 23/085
JP 2005337527 A * 12/2005 ..... F28D 1/0391

OTHER PUBLICATIONS

English language abstract for DE 102004049809 extracted from espacenet.com database on Apr. 9, 2014,19 pages.
English language abstract and machine-assisted translation for DE 102006006670 extracted from espacenet.com database on Apr. 9, 2014, 30 pages.
English language abstract and machine-assisted translation for FR 2923591 extracted from espacenet.com database on Apr. 9, 2014, 24 pages.
PCT International Search Report for Application No. PCT/EP2012/055790, dated Apr. 27, 2012, 5 pages.
English language abstract for FR 2896 678 extracted from espacenet.com database on May 30, 2019, 1 page.
English language abstract and machine-assisted English translation for JPH 10-122778 extracted from espacenet.com database on May 30, 2019, 23 pages.

* cited by examiner

HEAT EXCHANGER TUBE, AND CORRESPONDING HEAT EXCHANGER PRODUCTION METHOD

RELATED APPLICATIONS

This application is the National Stage of International Patent Application No. PCT/EP2012/055790, filed on Mar. 30, 2012, which claims priority to and all the advantages of French Patent Application No. FR 1152705, filed on Mar. 31, 2011, the content of which is incorporated herein by reference.

The invention relates to a heat exchanger tube, notably for motor vehicles, to a heat exchanger comprising a core bundle of such tubes, and to a method of obtaining such a tube.

The invention relates to the technical field of heat exchangers, notably for motor vehicles.

BACKGROUND

In general, heat exchangers conventionally comprise a core bundle of tubes and two collector tube plates through which the ends of the tubes of the core bundle of tubes pass and which are capped by fluid distribution box covers. There may be inserts placed between the tubes of said core in order to improve the exchange of heat.

There are two main technologies employed in the manufacture of these tubes. Either extrusion, which gives rise to a high cost (specific dies for each type of tube), or bending, offering different advantages. In the latter distance, the tubes used are produced by bending a metal strip over on itself.

Heat exchanger tubes may be subjected to numerous stresses such as high-speed impact with an object (for example a stone chipping) coming from the external environment. Heat exchanger tubes are therefore subjected to external stresses.

They are also stressed from the inside by the flow of the fluid. Specifically, during operation, the tubes are subjected to thermal, pressure, expansion stresses.

Sufficient material strength at tube level has to be guaranteed.

One known solution is to allow the tube to withstand such an impact in order to avoid any leak of fluid, or to withstand the internal stresses, by locally increasing the thickness of the wall of the tube in the case of an extruded tube.

However, in the case of a bent tube, the tube cannot be reinforced by simply increasing the thickness of material as it can in the case of an extruded tube.

As far as bent tubes go, there is, for example, a known solution whereby the wall of the tube is bent over on itself horizontally several times in the region of one side or nose of the tube, increasing the thickness of material at the nose of the tube. A disadvantage lies in the fact that the height of the tube is thus dependent on the material thickness thereof and corresponds to the number of folds.

According to another solution set out in document DE 102006006670, the tubes have numerous vertical folds. One major disadvantage with this solution is that it causes excessive amounts of material to be used.

U.S. Pat. No. 6,192,977 sets out yet another solution in which one end of the tube consists of the overlapping of the tube wall. However, this solution is difficult to master in the case of tubes of small height, for example of the order of 1 mm or even 1.75 mm.

SUMMARY OF THE INVENTION

It is therefore an objective of the invention to propose a solution for a bent tube that gives the tube sufficient resistance to the external stresses and to the internal stresses without having the above-mentioned disadvantages of the prior art.

To this end, one subject of the invention is a heat exchanger tube produced by bending a metal strip, characterized in that said strip has a thickness that can vary between at least one first thickness and at least one second thickness greater than said first thickness, and in that said tube has thinned first zones and reinforced second zones located at the points of greatest mechanical stress, said first zones being formed by first portions of said strip of first thickness and said reinforced second zones being formed by second portions of said strip of second thickness.

Thus the tube still has a conventional thickness at the points of greatest stress, whether the stresses come from outside the tube or inside as a result of the circulation of the fluid.

Said tube may further have one or more of the following features, considered separately or in combination:

- the variable thickness of said strip is obtained by localized thinning of said strip,
- said strip has opposite margins of second thickness and said tube has a reinforced second zone obtained by bending said margins over and by joining said bent-over margins together,
- said tube has a roughly B-shaped cross section defining two parallel canals for the circulation of fluid, which are delimited by a separation,
- said separation is formed by the joining-together of said bent-over margins of said metal strip,
- said tube has two opposite large lateral faces which are connected by two small lateral faces, said small lateral faces being reinforced second zones,
- said tube has at least one zone of contact between at least one margin of said strip and the internal surface of said tube formed from said bent strip, said at least one margin and said internal surface respectively forming reinforced second zones.

The invention also relates to a heat exchanger, notably for a motor vehicle, characterized in that it comprises a core bundle of tubes as defined hereinabove.

The invention also relates to a method of obtaining such a heat exchanger tube, characterized in that it involves the following steps:

- a metal strip is locally thinned so as to define first portions of first thickness and second portions of second thickness greater than said first thickness,
- said metal strip is bent in the region of at least one second portion, and
- a join is made in the region of at least two second portions of said strip so as to form a tube that has thinned first zones and reinforced second zones located at the points of greatest mechanical stress, said first zones being formed by first portions of said strip of first thickness and said reinforced second zones being formed by second portions of said strip of second thickness.

According to one embodiment, said metal strip is cut to the desired length after it has been bent.

Said metal strip may be locally thinned by rolling.

According to another embodiment, the method involves a preliminary step of cutting said metal strip to the desired length before bending.

Said metal strip can be locally thinned by pressing.

According to one embodiment, said metal strip is bent in such a way as to form a tube of roughly B-shaped cross section, defining two parallel canals for the circulation of fluid, which are delimited by a separation.

BRIEF DESCRIPTION OF THE DRAWINGS

Further features and advantages of the invention will become more clearly apparent from reading the following description, which is given by way of illustrative nonlimiting example, and from studying the attached drawings among which.

DETAILED DESCRIPTION

In these figures, elements that are substantially identical bear the same references.

The invention relates to tubes 1 for heat exchangers.

By way of example, mention may be made of heating radiators, cooling radiators, charge air coolers or even air-conditioning condensers for motor vehicles.

Figure 1:
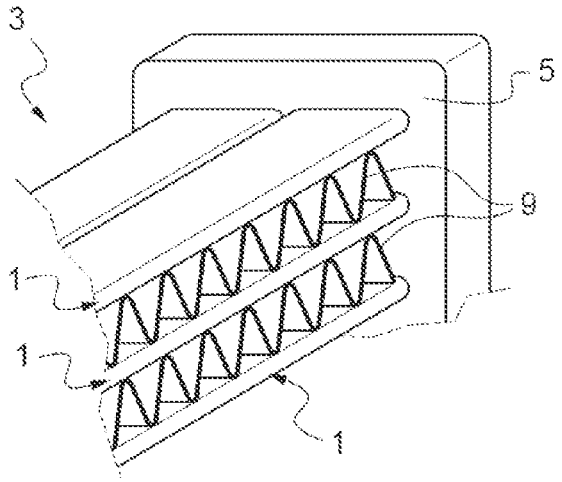
FIG. 1 is a partial and schematic depiction of a heat exchanger.

As illustrated partially in FIG. 1, a heat exchanger 3 conventionally comprises a core bundle of longitudinal tubes 1 (cf. FIGS. 1 and 2*a*) mounted between two distribution boxes through which a first fluid flows by means of collector tube plates 5 (depicted partially and schematically) arranged transversely to the tubes 1 and having orifices (not depicted) to receive the ends of these tubes 1.

Disturbance inducers 7 (FIG. 2*a*), for example of substantially corrugated shape, may be placed inside the tubes 1 so as to disturb the flow of the first fluid through the tubes 1 while increasing the exchange surface area. These disturbance inducers 7 are, for example, brazed to the tubes 1 at the crests 7*a* of their corrugations and, for example, at the ends 7*b* of the disturbance inducers 7.

The disturbance generated by the presence of these disturbance inducers 7 in the tubes 1 facilitates exchanges of heat between the two fluids. These disturbance inducers 7 are well known to those skilled in the art and are not described in greater detail herein. This example is applicable to the operation of a condenser.

The tubes 1 may be separated from one another by inserts (FIG. 1), for example corrugated inserts, through which the second fluid passes to exchange heat with the first fluid. These inserts 9 in the example illustrated are positioned transversely to the longitudinal axis of the tubes 1.

The various metal component parts of such a heat exchanger 3 may be assembled and then brazed together by passing through a brazing furnace, in order to join all the component parts together.

Figure 2A:
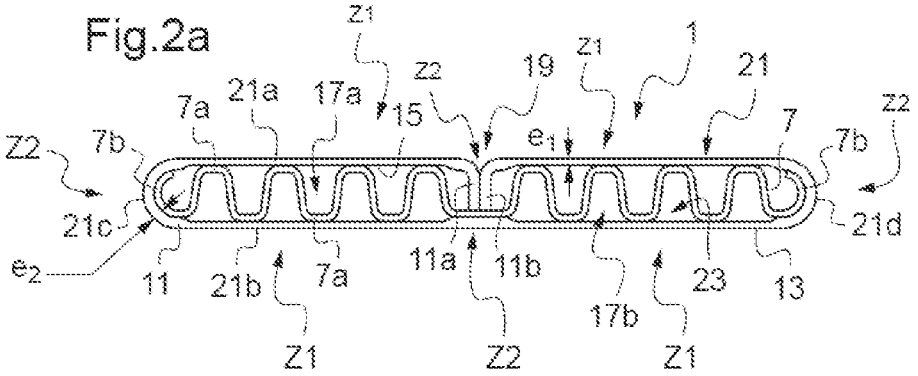
FIG. 2*a* is a view in cross section of a tube of the exchanger of FIG. 1, with inserts.
Figure 2B:
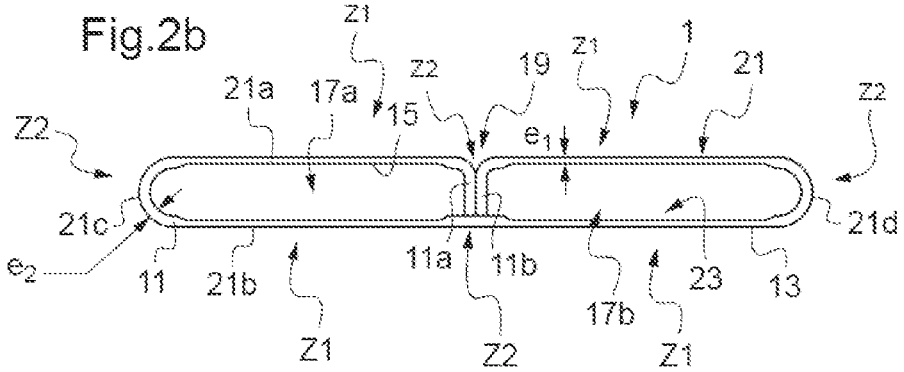
FIG. 2*b* is a view in cross section of a tube of the exchanger of FIG. 1, without inserts, FIG. 3*a* schematically illustrates a metal strip used to form the tube of FIG. 2*a*, FIG. 3*a* not being representative of the dimensions of the strip used to form the tube, FIG. 3*b* schematically illustrates the metal strip of FIG. 3*a*, thinned.

Reference is now made to FIGS. 2*a*, 2*b* which show a tube 1 of such a heat exchanger 3 in cross section.

Figure 3A:
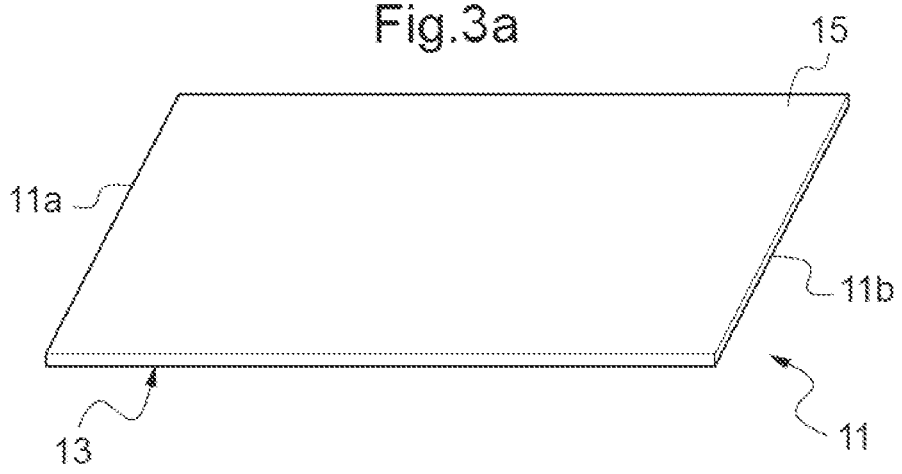

Such a tube 1 is made from a metal strip 11 (FIG. 3*a*). The strip 11 is depicted schematically and illustratively in FIG. 3*a*.

This metal strip 11 is thinned (FIG. 3*b*) then bent. It is then referred to as a "bent tube".

For that reason, the metal strip 11 has two opposite margins 11*a*, 11*b* which are joined together to form the bent tube 1 depicted in FIG. 2*b*.

The metal strip 11 (FIGS. 3*a*, 3*b*) is preferably made of aluminum or of aluminum alloy.

In the case of brazed exchangers, the metal strip is, for example, made of aluminum or of copper.

Of course, mechanical heat exchangers may also be foreseen.

The metal strip 11 is, for example, of roughly rectangular shape and comprises a first face referred to as the external face 13 and a second face referred to as the internal face 15 parallel to the external face 13 and opposite it. The terms "internal" and "external" are defined with respect to the inside and the outside of the bent tube 1.

The metal strip 11 (cf. FIG. 3*b*) has a variable thickness. This variable thickness can be obtained by localized thinning of the strip 11, for example by rolling.

Figure 3B:
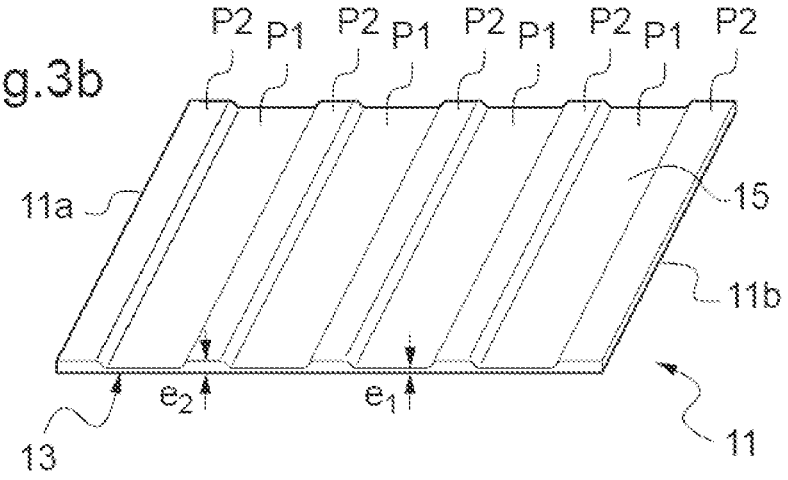

According to the example illustrated in FIG. 3*b*, the strip 11 has first portions P1 and second portions P2 of different thicknesses. These portions P1, P2 are illustrated schematically in FIG. 3*b* and the dimensions of the strip 11 and of the portions P1, P2 are not to scale.

The first portions P1 have a thickness $e_1$ which is smaller than the thickness $e_2$ of the second portions P2. By way of example, the thickness $e_2$ is of the order of 0.23 mm and the thickness $e_1$ is of the order of 0.15 mm.

These first portions P1 and second portions P2 are defined according to the load applied to the bent tube 1. The thicknesses $e_1$ and $e_2$ are therefore determined according to this load.

Specifically (FIGS. 2*a* to 3*b*), the first portions P1 are intended to form first zones Z1 of the tube 1, and the second portions P2 are intended to form second zones Z2. The second zones Z2 of greater thickness $e_2$ are therefore reinforced by comparison with the first zones Z1 of smaller thickness $e_1$ which are referred to as thinned zones. The second zones Z2 correspond to those zones of the tube 1 which are the most highly stressed.

These zones which are the most highly stressed are found notably where the margins 11*a*, 11*b* of the metal strip are joined together to form the tube 1. Another stress zone is located in the regions where the metal strip 11 is bent over.

According to the example illustrated in FIGS. 2*a*, 2*b*, the formed tube 1 has a roughly B-shaped cross section. Of course, other cross sections, for example of roughly oblong shape, could be foreseen.

The B-shaped cross section of the tube 1 illustrated has two fluid circulation canals 17*a* and 17*b* which are parallel, juxtaposed and separated by a separation 19 that forms a spacer.

To that end, the metal strip 11 is folded over to form the envelope of the two juxtaposed parallel canals 17*a* and 17*b*. More specifically, the metal strip 11 is bent in such a way that its internal face 15 delimits the two canals 17*a*, 17*b*.

The separation 19 is for example created by bending two opposite margins 11*a* and 11*b* of the metal strip 11, for example the longitudinal margins of the strip 11, over at roughly 90°. These bent-over margins 11*a*, 11*b* are then placed back to back so that they together form the separation 19. The external face 13 at the margin 11*a* therefore faces the external face 13 at the opposite margin 11*b*.

A B-shaped bent tube has been described here. Naturally, any type of bending or even electrically welded tubes may be provided for.

As mentioned earlier, the zone where the margins 11*a*, 11*b* of the metal strip are joined together to form the tube 1 may be stressed and in the example illustrated is a reinforced second zone Z2.

For that, the opposed margins 11*a*, 11*b* may be second portions P2 of second thickness $e_2$ of the strip 11. Once the tube 1 has been formed, it therefore has a reinforced second zone Z2. This reinforced second zone Z2 is obtained by bending the margins 11*a*, 11*b* of thickness $e_2$ over and by joining these bent-over margins 11*a*, 11*b* together.

In addition, in order to ensure the two canals 17*a*, 17*b* are independent of one another, the end faces of the margins 11*a*, 11*b* are more or less in contact with the internal face 15 of the metal strip 11.

Thus, once the strip 11 has been bent, the external face 13 of the strip 11 forms the external surface 21 of the tube 1 thus formed, and the internal face 15 of the strip forms the internal surface 23 of the tube 1 thus formed.

There is a zone of contact between the margins 11*a*, 11*b* of the metal strip 11 and the internal surface 23 of the bent tube 1.

Further, once the tube 1 has been formed there may be at least one zone of contact between at least one margin 11*a*, 11*b* of the strip 11 and the internal surface 23 of the tube 1. In addition or as an alternative to the margins 11*a*, 11*b* created at second portions P2 of the strip, the internal surface 23 in the region of this contact zone corresponds to a second portion P2 of the strip 11 so as to form a reinforced second zone Z2.

In addition, the external surface 21 of the bent tube 1 has two opposite large external faces 21*a*, 21*b* which are connected by two small lateral faces 21*c* and 21*d*, for example substantially curved ones.

According to this embodiment, in order to form such a tube 1, the small lateral connecting faces 21*c*, 21*d* form second zones Z2 of the tube 1. For that, the strip 11 is bent over in the region of two second portions P2.

Thus, the metal strip 11 is therefore thinned before it is bent to form the tube 1 which, in the example illustrated, has legs of a first thickness $e_1$ forming the large lateral faces 21*a*, 21*b* of the B-shape apart from the margins 11*a*, 11*b* of the metal strip 11 and also apart from the internal surface 23 intended to be in contact with the ends of these margins 11*a*, 11*b* once the strip 11 has been bent. These legs forming thinned first zones Z1. Further, the margins 11*a*, 11*b* and the contact zone of the internal surface 23 have a second thickness $e_2$ forming reinforced second zones Z2.

A tube 1 bent roughly into a B-shape has been described here. Of course, other forms of embodiment of the tube 1 may be foreseen.

For example, it is possible to have a tube 1 that is bent in such a way as to define a single fluid circulation canal. In such a case, the metal strip 11 is bent over to form an envelope of this canal, this strip 11 being bent over in the region of a second portion P2 of the strip 11 so as to form a reinforced second zone Z2 of the bent tube 1.

As previously, the margins 11*a*, 11*b* of the strip may be bent over and placed back to back against one another. The junction between the margins 11*a*, 11*b* may also form a reinforced second zone Z2 of the tube; the margins 11*a*, 11*b* for example being formed in the region of second portions P2 of the strip 11.

As an alternative, rather than being bent over then placed back to back against one another, the margins 11*a*, 11*b* of the strip 11 may be superposed.

Figure 4:
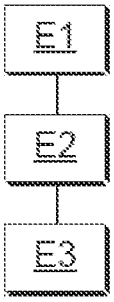
FIG. 4 depicts the steps of a method of obtaining the tube of FIG. 2*a*.

A method of obtaining such a bent tube 1 is now described with reference to FIGS. 2*b*, 3*b* and 4.

During a first step E1, the metal strip 11 is locally thinned.

In order to do that, a certain number of first portions P1 with a first thickness $e_1$ and of second portions P2 with a higher second thickness $e_2$ may be defined beforehand. These portions are determined according to the bending operations to be performed and according to the zones of the tube 1 that will be the most highly stressed once the tube is formed.

According to the example described, in order to obtain a tube 1 bent into a B shape, four first portions P1 are thinned down to a thickness $e_1$ less than the thickness $e_2$ of the rest of the strip 11 forming the second portions P2, there being in the example illustrated five portions P2, namely a central portion, two intermediate portions and two end portions forming the margins 11*a*, 11*b* of the strip 11.

This thinning may for example be performed by rolling. The first portions P1 are, for example, passed between two rollers to reduce their thickness down to the desired thickness $e_1$, for example 0.15 mm as compared with an initial thickness of 0.23 mm.

During a step E2, the strip 11 is bent or curved in the region of at least one second portion P2 of the strip 11.

This bending can be done by passing the metal strip 11 continuously through a multiple-roller rolling mill.

According to the example described, in order to obtain a tube 1 bent into a B shape, the strip 11 is bent in the region of the two intermediate portions P2.

According to an alternative, the thinning step may be performed during the bending of the strip 11. To do that, bending rollers may be provided that also have a calendering rolling function.

Finally, in a third step E3, at least two second portions P2 are joined together to form the bent tube 1.

According to the example described, in order to obtain a tube 1 bent into a B shape, the two end portions P2 that form the margins 11*a* and 11*b* of the strip 11 are bent for example at more or less 90°, then these bent-over margins 11*a*, 11*b* are placed back to back against one another so that together they form the separation 19 that delimits the two canals 17*a*, 17*b*.

The end faces of these margins 11*a*, 11*b* therefore come into contact with the central second portion P2.

Once the bends have been formed, the metal strip 11 can be cut to the desired length.

In an alternative, the metal strip is cut to the desired length beforehand.

The cut strip 11 can be locally thinned by pressing (stamping).

Each piece of cut strip 11 can then be bent, for example by passing it through a multiple-roller rolling mill stand.

As before, this bending can be done in such a way as to obtain a tube bent more or less into a B shape, or even any other shape.

The tube 1 then has thinned first zones Z1 and reinforced second zones Z2, the first zones Z1 being formed by first portions P1 of the strip 11 and the reinforced second zones Z2 being formed by second portions P2 of said strip 11 of greater thickness than the first portions P1.

It can then all be joined together when the heat exchanger 3 is being brazed.

It will therefore be appreciated that, with such a bent tube 1 of variable thickness, the weight of the bent tube 1, and therefore of the exchanger 3 comprising a plurality of such tubes 1, can be reduced while at the same time ensuring that there is enough material at the strategic points that the tubes 1 can withstand the stresses applied to them.

The invention claimed is:

1. A heat exchanger flat tube produced by bending a metal strip, said tube comprising:

parallel first and a second canals created by the bending of the metal strip, said first and second canals separated by bent ends of the metal strip, wherein said bent ends bend down from a top wall of said tube such that said bent ends of the metal strip bend perpendicular to a bottom wall of said tube and are parallel to each other, and edges of said bent ends of the metal strip face said bottom wall of said tube, and wherein said bent ends of the metal strip and a section of said bottom wall of said tube which said bent ends face are of a greater thickness than a thickness of said top wall and a portion of said bottom wall, and said greater thickness of said bent ends through said bends and to said edges of said bent ends is of uniform thickness; and said tube having a thickness at a rounded leading edge of said tube and a rounded trailing edge of said tube, which are respectively outside walls of said first and second canals, and said thickness of said outside walls is greater than said thickness of said top wall and a portion of said bottom wall.

2. The heat exchanger flat tube as claimed in claim 1, wherein the metal strip comprises a variable thickness such that said greater thickness is obtained by bending the metal strip.

3. The heat exchanger flat tube as claimed in claim 2, wherein said tube has a roughly B shaped cross section defining said first and second canals for a circulation of fluid, which are delimited by a separation.

4. The heat exchanger flat tube as claimed in claim 3, wherein said separation is formed by the joining together of said bent ends of the metal strip.

5. A heat exchanger for a motor vehicle, wherein the heat exchanger comprises a core bundle having at least one heat exchanger tube as claimed in claim 1.

6. The heat exchanger flat tube as claimed in claim 5, wherein the metal strip comprises variable thickness such that said greater thickness is obtained by bending the metal strip.

7. The heat exchanger flat tube as claimed in claim 5, wherein said tube has a roughly B shaped cross section defining said first and second canals for a circulation of fluid, which are delimited by a separation.

8. The heat exchanger flat tube as claimed in claim 1, wherein the metal strip varies in thickness between said thickness and said greater thickness.

9. The heat exchanger flat tube as claimed in claim 1, wherein each of said edges of said bent ends exclusively contacts said bottom wall.

10. The heat exchanger flat tube as claimed in claim 2, wherein said variable thickness of the metal strip is obtained by localized thinning of the metal strip prior to any bending.

11. The heat exchanger flat tube as claimed in claim 10, wherein said variable thickness of the metal strip is obtained by localized thinning of the metal strip by rolling the metal strip prior to any bending.

12. The heat exchanger flat tube as claimed in claim 10, wherein said variable thickness of the metal strip is obtained by localized thinning of the metal strip by pressing the metal strip prior to any bending.

13. A method for obtaining a heat exchanger tube, wherein the method comprises:

locally thinning a metal strip by pressing or rolling so as to define first portions of a thickness and second portions of a greater thickness, bending the metal strip in a region of at least one second portion, and forming a join in a region of at least two second portions of the metal strip so as to form a tube that has parallel first and second canals created by the bending of the metal strip, the first and second canals separated by bent ends of the metal strip, wherein the bent ends bend down from a top wall of the tube such that the bent ends of the metal strip bend perpendicular to a bottom wall of the tube and are parallel to each other, and edges of the bent ends of the metal strip face the bottom wall of the tube, and wherein the bent ends of the metal strip and a section of the bottom wall of the tube which the bent ends face are of a greater thickness than a thickness of the top wall and a portion of the bottom wall, and the greater thickness of the bent ends through the bends and to the edges of the bent ends is of uniform thickness; and the tube having a thickness at a rounded leading edge of the tube and a rounded trailing edge of the tube, which are respectively outside walls of the first and second canals, and the thickness of the outside walls is greater than the thickness of the top wall and a portion of the bottom wall.

14. The method as claimed in claim 13, wherein the metal strip is cut to a desired length after the metal strip has been bent.

15. The method as claimed in claim 14, wherein the metal strip is locally thinned by rolling.

16. The method as claimed in claim 13, further comprising cutting said metal strip to a desired length before bending.

17. The method as claimed in claim 16, wherein the metal strip is locally thinned by pressing.

18. The method as claimed in claim 13, wherein the metal strip is bent in such a way as to form a tube of roughly B shaped cross section, defining the first and second canals for a circulation of fluid, which are delimited by a separation.

* * * * *